US005175974A

United States Patent [19]

Martinsen et al.

[11] Patent Number: 5,175,974

[45] Date of Patent: * Jan. 5, 1993

[54] REPAIRING SQUEAKING FLOORS

[76] Inventors: Lyle J. Martinsen, 315 E. 6310 South; Stewart L. Martinsen, 631 Mount Vernon Cir., both of Murray, Utah 84107; Lane G. Martinsen, 7443 S. Rich Way, Salt Lake City, Utah 84121

[ * ] Notice: The portion of the term of this patent subsequent to Jan. 19, 2010 has been disclaimed.

[21] Appl. No.: 826,348

[22] Filed: Jan. 27, 1992

Related U.S. Application Data

[63] Continuation-in-part of Ser. No. 691,190, Apr. 25, 1991.

[51] Int. Cl.[5] ..... E04B 1/00

[52] U.S. Cl. ..... 52/743

[58] Field of Search ..... 52/514, 741, 743, 744, 52/408, 410, 480

[56] References Cited

U.S. PATENT DOCUMENTS

| | | | |
|---|---|---|---|
| 2,187,324 | 1/1940 | Many | 52/744 X |
| 3,572,956 | 3/1971 | Liscum | 52/744 X |
| 3,900,541 | 8/1975 | Klapwijk . | |
| 4,269,014 | 5/1981 | Grammerstorf | 52/744 X |
| 4,512,123 | 4/1985 | Fischer | 52/744 X |
| 4,644,720 | 2/1987 | Schneider . | |
| 4,809,478 | 3/1989 | Bernard | 52/743 X |

*Primary Examiner*—David A. Scherbel
*Assistant Examiner*—Creighton Smith

[57] ABSTRACT

Novel methods and apparatus are disclosed by which squeaking construction joints in floors, stairs and furniture are facilely, reliably and economically repaired by internal injection of glue or the like along a newly created passageway, without the disassembly of the joints.

20 Claims, 4 Drawing Sheets

REPAIRING SQUEAKING FLOORS

CONTINUITY

This application is a continuation-in-part of our copending U.S. patent application Ser. No. 691,190, filed Apr. 25, 1991.

FIELD OF THE INVENTION

The present invention relates generally to the repair of structures in homes and other buildings and, more particularly, to novel methods and apparatus by which squeaking structures such as floors, stairs and furniture in a residence, commercial building or elsewhere are reliably, facilely and economically repaired.

THE PROBLEM

It is a common experience to walk across a floor or up a flight of stairs of a residential, commercial or other building and hear a wood-based squeak in response to placement and removal of weight of the person crossing the floor. Furniture, such as a rocking chair, sometimes similarly squeaks during use. Floors, stairs and/or furniture squeaking may be caused by a number of variables, but relative movement at joints between neighboring construction components, and relative movement between parts of the flooring, stairs and/or furniture are chief causes of the problem. Loosening of nails, connectors and/or other structural fasteners, such as staples and dowels, contributes to the problem.

The aforementioned squeaking floor, stair and furniture problems have defied reliable, facile and economical solution for many years, indeed decades.

Nails driven through a floor or stair covering, the floor or stair and into, if not through, the subfloor or other underlying support or between furniture components usually help somewhat, but do not cure the problem. Typically, the residual exposed portions of such nails are unsightly and loosening nails may add an element of danger.

One approach which normally works for floors, but involves reconstruction as opposed to repair and is normally cost prohibitive, is that of taking up the floor covering and the elevated part of the floor, leaving the subfloor exposed. Thereafter, on a labor intensive basis, the old floor or a new floor is superimposed upon the exposed subfloor using glue and screw fasteners. New floor covering is then placed over the floor. Even when the reconstruction is completed, some squeaking due to relative floor movement may still occur. The inconvenience often rules out this reconstruction approach, even where financial considerations are not prohibitive.

Stair squeaks often comprise relative movement between a step and a riser and repair, as is true in the case of the floor, often involves labor intensive reconstruction and may not be fully effective. Reoccurrence of squeaks after repair is likely. As stairs are often commonly and singularly used pathways, inconvenience in rebuilding, reconstructing or repairing a stairway is often significantly greater than repair of a floor in a single room where foot traffic may be redirected during the repair.

Because of cost, inconvenience, and uncertainty of repair, many, if not most, floor and stair squeaks are left unattended. This creates an ongoing annoyance, often one of significant magnitude due to interruption in sleep, embarrassment when guests and visitors are present, and the loss of a sale to a prospective buyer of the building.

Furniture squeaks are usually the result of one member moving against or in relation to another construction member at a loose joint. While such movement more commonly occurs in older furniture where wear and other factors cause the joint to loosen, new furniture sometimes squeaks also.

From the foregoing, it is clear that there has long existed an unsatisfied need for a reliable, facile and economical way to repair squeaks in floors, stairs, furniture and other construction joints reparable by the invention.

BRIEF SUMMARY AND OBJECTS OF THE INVENTION

In brief summary, the present invention overcomes or substantially alleviates the problem mentioned above and comprises novel methods and apparatus by which squeaky floors, stairs and furniture are reliably, facilely and economically de-squeaked without disassembly of construction components or significant removal of a floor, stair or furniture coverings (where such coverings are involved).

With the foregoing in mind, it is a primary object to overcome or substantially alleviate the above-mentioned problem of the related art.

Another object of significance is the provision of novel methods and apparatus by which a squeaky floor can be de-squeaked.

Still another object of significance is the provision of novel methods and apparatus by which a squeaky stair can be desqueaked.

Another object of consequence is the provision of novel methods and apparatus by which a piece of squeaky furniture can be de-squeaked.

A further important object is the provision of methods and apparatus by which squeaking floors, stairs and furniture can be novelly repaired in a reliable, facile and economical fashion.

Still another paramount object is the provision of methodology, materials, and equipment by which a floor or stair can be novelly de-squeaked without disassembly of components comprising the floor or significant removal of the floor or stair covering.

Another principal object is the provision of methodology, materials, and equipment by which an assembled piece of furniture can be effectively and facilely desqueaked.

These and other objects and features of the present invention will be apparent from the detailed description taken with reference to the accompanying drawings.

DETAILED DESCRIPTION OF THE ILLUSTRATED EMBODIMENTS

Reference is now made in detail to the drawings wherein like numerals are used to designate like parts throughout. Essence of the present invention is to eliminate a squeak in a construction joint in a building or in a piece of furniture by internally injecting glue or other suitable flowable and curable filler material or substance into the joint in such a way that, when the glue or other filler material solidifies, an essentially monolithic floor results where components, in the area of the injection, are no longer free to move one in respect to another.

It has been found that the injection of glue or the like at an interface internal within a floor immediately above the top surface of the subfloor causes the glue to infiltrate the interface as well as contiguous seams, joints, and nail holes. Also, the fibers of the wood located adjacent to the interface are infiltrated and impregnated. Nails and other fasteners are encapsulated at the injection site in such a way that, upon curing of the glue, the floor at the injection site no longer comprises components which may move one in respect to another to cause squeaking. The present invention also contemplates injection of glue or the like between the bottom of a subfloor and the top of a floor joist, to prevent relative movement and thereby prevent further squeaking.

It has also been found that injection of glue or the like between interfaces of steps and risers in a stair similarly prevents relative movement between the steps and risers and terminates squeaking, as does injection of glue or the like into furniture joints which comprise squeak-producing interfaces.

An additional paramount focus of the present invention is to do the foregoing in a reliable, facile, and economical fashion whereby construction components do not have to be disassembled and reassembled and no substantial or material removal of floor covering over the joint is necessary. Typically, all of the squeaks in the construction of an average residence can be de-squeaked in accordance with the principles of the present invention in only a few hours and at a modest cost.

Figure 1:
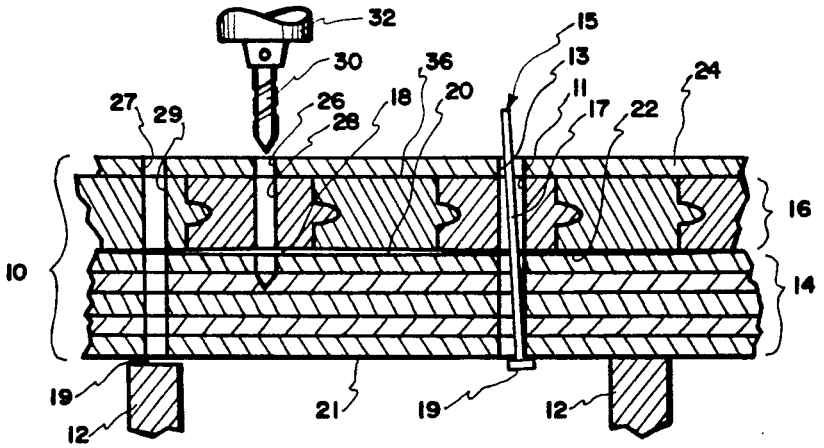
FIG. 1 is a fragmentary cross-sectional view illustrating some steps and equipment used in accordance with the principles of the present invention, by which a linoleum-covered floor may be drilled to de-squeak the floor.

More specifically, with regard to floors and floor joints and with reference to FIG. 1, a floor 10 is illustrated as being supported upon horizontally directed floor joists 12, in a conventional and well-known manner. Floor 10 is illustrated as being a multi-layer subfloor 14 comprising plywood and a floor or top floor segment 16, illustrated as comprising tongue and groove boards assembled conventionally. While not the only cause of a squeaky floor problem, FIG. 1 illustrates the existence of a cavity 18 between the top surface 20 of the subfloor 14 and the bottom surface 22 of the tongue and groove layer 16. Thus, the gap 18 is disposed at an interface between the subfloor 14 and the floor 16. The existence of the gap 18 is intended to illustrate broadly a condition which allows floor components to move one in respect to another to precipitate a squeaking noise as one walks across the floor 10. FIG. 1 also illustrates the existence of a gap 19 between the bottom surface 21 of the subfloor 14 and the top of the left floor joist 12.

Floor 10 also comprises a top floor covering 24 which may comprise any solid floor covering such as linoleum, tile, vinyl, or the like.

In some circumstances, the total depth of floor 10 will be known to the homeowner or someone available to the home owner for information, such as the contractor who originally constructed the home. In other instances, there may be locations where the total depth of floor 10 can be visually observed and measured for purposes of determining drilling depth during the de-squeaking process. In still other circumstances, the vertical depth of the floor 10 will be unknown. In such instances, it is presently preferred that a test hole be drilled through the floor 10 for the purpose of determining depth. Such a drill hole is illustrated at bore 11 in FIG. 1, the drilling of bore hole 11 preferably being accomplished after careful removal of a small disc in the floor covering 24 to create access hole 13. It is preferred that the diameter of the hole 13 and of the bore 11 be very small and that the location thereof be at a site of the floor 10 where squeaking does not exist.

To determine floor depth, it is presently preferred that a suitable hole depth locator or probe, generally designated 15, be used. Probe 15 comprises a very small diameter stem 17 and a disc 19' integrally disposed with the stem 17 at the distal end thereof. The stem 17 may be wire-like in its configuration and the diameter disc 19' must be less than the diameter of the bore 11 by inserting the probe 15 through the hole 13 and bore 11 to a location such that the disc 19' is disposed below the bottom surface 21 of the subfloor 14 is undertaken preparatory to depth determination. Thereafter, the probe 15 is placed at a slight angle in respect to the vertical and manually lifted until the disc 19' is contiguous with the surface 21. The user marks the stem 17 exposed above the floor covering 24 in such a way that, upon retrieval of the probe 15 from the bore 11, leaves the user in a position where he or she can measure the distance between the finger gripping site at the proximal end of the probe 15, obtained in the manner described above, and the disc 19'. Once the depth of floor 10 has been so determined, the depth of penetration during the de-squeaking process can be readily determined in the manner set forth hereinafter.

Figure 8:
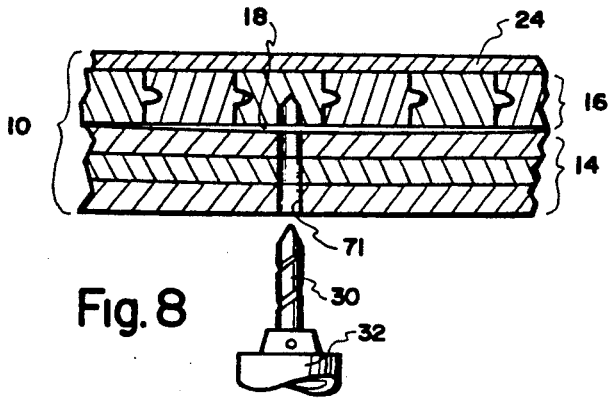
FIG. 8 is a fragmentary cross-section illustrating some steps and equipment used in accordance with the principles of the present inventor, by which a floor may be de-squeaked from a location below the floor.

After the depth of the floor 10 has been ascertained, it is necessary to create an opening 26 and/or 27 in the floor covering 24. This ca be done in any suitable way. For example and without limitation, one or both holes 26 and 27 in the floor covering 24 may be drilled, cut, reamed, cored, or removed in any suitable way. The removal may be such that the portion of floor covering 24 removed from openings 26 and/or 27 is preserved as a plug for reinsertion into holes 26 and/or 27 after the cavity 18 and/or 19 is grouted, as explained herein in greater detail. The creation of the holes 26 and 27 presume that cavity 18 and gap 19 are reached from the top, rather than from the bottom, as illustrated in FIG. 8.

In order to complete the requirement for access to the interface 18 from the top of the floor 10, it is necessary that an access passageway 28 be formed in the floor 16, in alignment with opening 26. Similarly, to reach gap 19 an access passageway 29 must be formed through both the floor 16 and the subfloor 14. In order to minimize an visual degradation to the floor covering 24 and to facilitate improved injection of flowable glue or the like, it is preferred that the openings 26, 27, 28 and 29 be small diameter. Experience to date indicates that access passageways on the order of 50/1000 of one inch may be used in practicing the present invention. Of course, if desired, larger access openings may be implemented. However, the larger the access opening the greater the risk that damage to the floor covering 24 may be caused to the extent that it will visually impair the appearance of the floor covering after the de-squeaking procedures have been completed.

One currently preferred mode of creating the excess passageways comprising openings 26 and 28 and 27 and 29 is to use a small bore bit 30 in conjunction with a conventional drill 32. The drill 32 may be either hand-held or mounted in some type of a suitable drill press to insure correct alignment and reciprocation.

The initial step in determining the floor location for the access passageway comprising openings 26 and 28 or 27 and 29 is to simply walk upon the floor and to identify those areas where squeaks are generated as one traverses the floor. As many access passageways comprising openings 26 and 28 and/or 27 and 29 as necessary may be drilled in any floor area sufficient to make the floor in that area monolithic, as explained hereinafter, so as to remove the squeak. The spacings between access passageways is not critical and may be as close or as distant as is necessary to eliminate the squeaking noise.

It is to be appreciated from an analysis of FIG. 1 that in effect, the access passageway comprising openings 26 and 28 essentially comprises a blind bore, the internal depth of which accommodates injection of glue or the like into interface 18. Similarly, the access passageway comprising openings 27 and 29 essentially comprises a blind bore, the internal depth of which is common within gap 19.

The depth of the bore 28 is selected by subtracting some predetermined distance from the depth of the floor 10 as determined by information, inspection or as a consequence of using probe 15 in bore 11 as explained above. For example, the operator may subtract one-half of one inch from the depth of floor 10 to establish the depth to which bore 28 is to be drilled. Preferably, blind bore 28 will extend somewhat into subfloor 14, as illustrated in FIG. 1. It is currently believed that the bottom of bore 28 must be at least on the order of one-quarter of one inch above the bottom surface 21 of the subfloor 14.

Figure 2A:
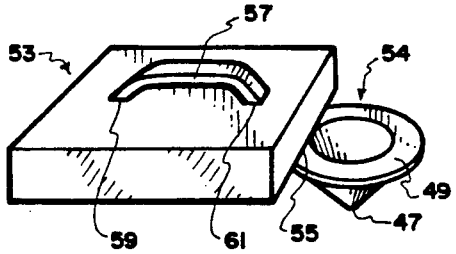
FIG. 2*a* is a perspective view of a funnel-shaped drill guide without spike retainers.
Figure 2:
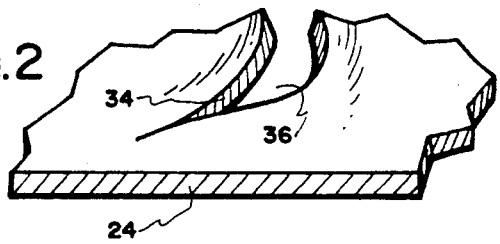
FIG. 2 is a fragmentary plan view of one manner by which a small area of linoleum or like floor covering may be slit and temporarily opened to floor drilling or other penetration in the course of practicing the present invention.
Figure 3:
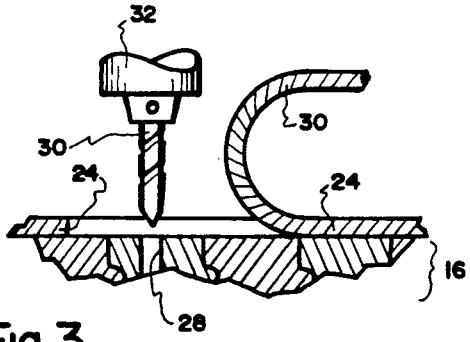
FIG. 3 is a fragmentary cross-section illustrating some steps and equipment used, in accordance with the principles of the present invention, by which a linoleum-covered floor may be drilled to de-squeak the floor.

With reference to FIGS. 2 and 3 it is to be appreciated that the creation of a blind bore access passageway to the interface at the top surface 20 of the subfloor 14 or to gap 19 can be achieved without drilling or coring of the floor covering 24. For example, in regard to FIG. 2, a surgical-like incision 34 may be made in the linoleum or like floor covering 24, using a sharp, thin blade. The lips of the floor covering 24 at the incision 34 may be manually spread so as to become separated from the top surface 36 of the floor 16. This drill bit 30 may then be inserted through the incision 34, in its rolled-backed or open state, to create the bore 28 and/or the bore 29 in the floor 16, essentially as illustrated in FIG. 1.

In a similar fashion, with reference to FIG. 3, a flap 30 may be cut from the remainder of the floor covering at 24 using a sharp knife or the like and pealed, back in the manner illustrated, to expose the top surface 36 of the floor 16 for drilling purposes using bit 30 and conventional drill 32. While illustrated as being a large flap in FIG. 3, the size of the flap is immaterial so long as the floor 16 is adequately exposed for drilling or the like. Advancement of the drill 32 with rotating drill bit 30 in a downward direction readily removes material from its path at floor 16 to create the bore 28.

For purposes of explaining one way the present invention may be used to eliminate a floor squeak below a carpeted area of the floor at gap 18, reference is made to FIG. 4. Specifically, the pile 50 of the carpet 52 is parted manually and a metal funnel device, generally designated 54, is placed into the parted area, spout down, to hold the pile away from the area where an access passageway to interface 18 is to be formed. Note that carpet 52 comprises a fabric backing 56 tautly superimposed over a layer of carpet pad 58. The lower annular tip 47 of the funnel device is preferably relatively sharp and is forced manually between threads of the carpet backing 56 and through the foam pad 58 until the tip 47 is essentially contiguous within the top 36 of the floor 16.

It is presently preferred that the angle formed by the cone-shaped portion of the funnel device be on the order of 45° in respect to both horizontal and the vertical. This creates a relatively shallow funnel-shaped mechanism, while at the same time allowing the user thereof to visually observe the tip 47 as it is advanced through the threads of the carpet and the foam pad as explained above.

The drill 32 with its bit 30 are aligned with the spout opening 60 of the funnel device at tip 47 and displaced in a downward direction substantially perpendicular to the plane of the floor 10'. The rotating bit 30 drills hole 64 in the floor layer 16, the bore 64 being illustrated as terminating slightly below the interface 18. Upon removal of the drill bit 30, the hole 64 essentially comprises a blind bore access passageway along which flowable filler material, such as glue, is injected into the interface 18 as hereinafter more fully explained. The funnel device 54 is left in the position illustrated in FIG. 4 through the glue injecting step, as explained hereinafter.

Figure 5:
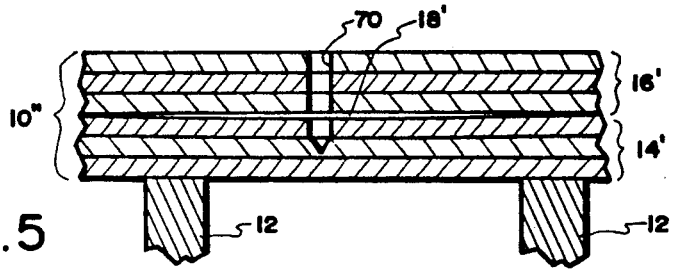
FIG. 5 is a fragmentary cross-section illustrating some steps and equipment used, in accordance with the principles of the present invention, by which a floor having no covering may be de-squeaked.

With reference to FIG. 5, the manner in which an access passageway is created for practicing the present invention with new construction prior to placement of a floor covering over the floor 10" or where floor covering has been removed from floor 10" is illustrated. Specifically, the floor 10 is illustrated as comprising a multiple layer plywood floor 16' and a multiple layer plywood subfloor 14' having an interface 18' disposed between the floor 16' and the subfloor 14'. An access passageway 70 is illustrated as having been drilled or otherwise created from the top down to a location slightly beyond where the access opening 70 intersects the interface 18'. The access opening 70 is used, as hereinafter explained, for the injection of glue or other suitable flowable filler material into the interface 18'.

The present invention also recognizes the desirability, which may exist under some circumstances, of accessing to the subfloor interface 18 of the floor 10 from the underside of the floor using the drill 32 and drill bit 30, or in any other fashion, to create upwardly directed access passageway. See access passageway 71 in FIG. 8.

Figure 9:
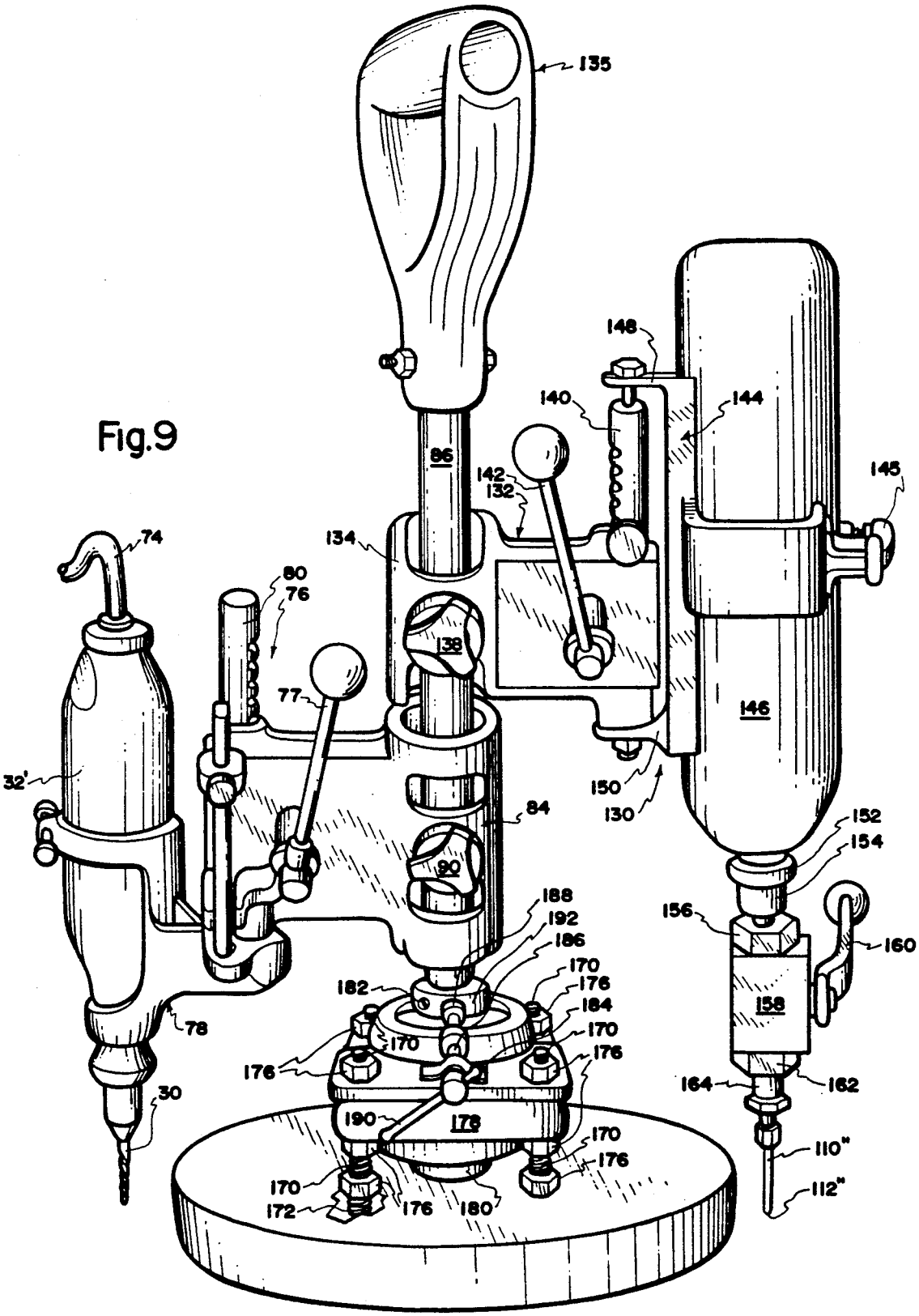
FIG. 9 is a perspective of equipment which may be used to drill and to inject filler glue to de-squeak a floor.

With reference to FIG. 9, it is to be appreciated that a drill 32', electrically serviced by cord 74, can be mounted to a drill press, generally designated 76, so that rotation of the drill press handle counterclockwise as illustrated in FIG. 9 will lower the drill 32' and bit 30 in a vertical orientation to create an access passageway of the type and as described above. The drill 32' is illustrated as being non-rotatably supported, in the shown position in FIG. 9, by a conventional bracket, generally designated 78, in a well known fashion. Bracket 78 is connected to the rack shaft 80 of the drill press 76 at the lower end thereof so that the drill 32', the drill bit 30, and the bracket 78 move up and down as the rack shaft 80 conventionally moves up and down responsive to manual manipulation of the handle 77.

Shaft 80 is reciprocally carried in a conventional housing, generally designated 84, one side of which surrounds a central mounting shaft 86 and is non-rotatably secured thereto by a conventional set screw manually set by handle 90. Thus, by rotation of bracket 76 around the shaft 86 after loosing of handle 90, the drill 32' and bit 30 can be rotated in a horizontal plane to a site where an access opening is to be created and, following creation of the access passageway, rotated to a remote position.

Figure 6:
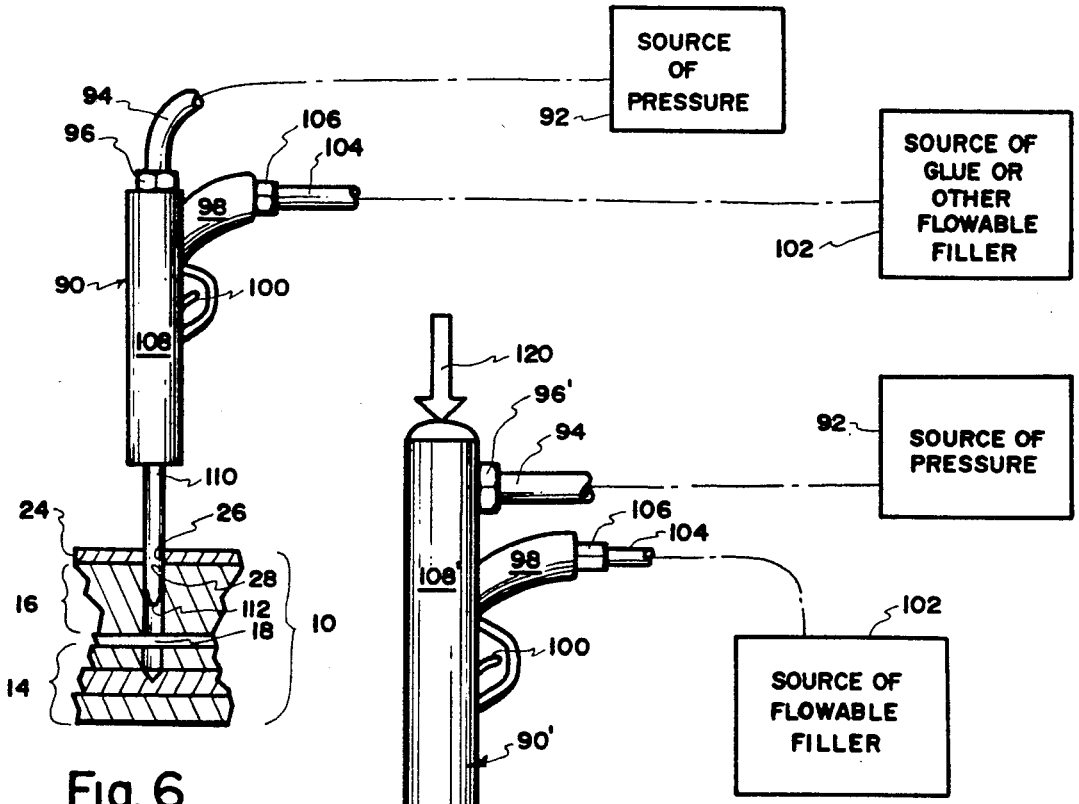
FIG. 6 is an elevational view, with parts broken away for clarity, of steps equipment for practicing the present invention to inject a filler glue to de-squeak a floor.

With specific reference to FIG. 6, there is illustrated a fragmentary segment of previously described floor 10, possessed of an access opening comprising bores 26 and 28. The diametral size of the composite access passageway comprising bores 26 and 28, as mentioned above, is preferably only a few thousandths. For example, 50/1000 of one inch is typically acceptable.

FIG. 6 illustrates an injection gun, generally designated 90, of a conventional nature which is actuated by suitable source of pressure 92 delivered conventionally through the hollow interior of a conduit 94. Conduit 94 is connected to the gun 90 at a fitting in 96 in a conventional fashion and actuates an internal piston to reciprocate the same in a well known manner. Since, in many installations, pressures of 700 pounds per square inch are desirable to force the glue from the gun 90, typically the source of air or gas pressure 92 is a high pressure source.

The injection gun 90 comprises a manual handle 98 and a trigger 100. A predetermined charge of flowable glue or other suitable flowable filler from source 102 is delivered in a well-known and conventional fashion via hose or conduct 104 to the interior of the gun 90. Fitting 106 connects the conduit 104 to the gun 90 at the handle 98. Typically the handle 98 comprises an internal valve which in a conventional manner selectively opens and closes responsive to actuation of the trigger 100 to recharge a chamber of the gun 90 adjacent the reciprocating piston thereof in preparation for the injection of a predetermined quantity of flowable glue or other filler material.

The injection gun 90 is illustrated as comprising a barrel 108 which is interiorly hollow, the hollow interior thereof communicating with the hollow interior of a male projection 110 extending from the distal end of the gun 90. The length of the male projection 110 is sufficient to accommodate its placement well within any access passageway of the type described above for purposes of injecting the glue or other flowable filler material into the interface 18. The hollow interior of the male projection 110 communicates the glue or other flowable filler material to an effluent port 112 of the male projection 110 and from thence to the interface 18.

The diameter of the male projection 110 is preferably a few thousandths of one inch larger than the diameter of the bores 26 and 28 so that insertion of the male projection 110 into the access passageway comprising bores 26 and 28 creates a force-fit relationship which seals the access passageway adjacent the male projection 110 and prevents backflow of glue or the like between the male projection 110 and the bore 28. As a consequence, when the operator squeezes the trigger 100, the piston internal of the gun 90, responsive to the pressure applied to the proximal side thereof from source 92 is advanced distally placing the glue under pressure and extruding the glue from the distal effluent opening 112 along the internal distal portion of the bore 28 and thence along the interface 18. Thus, the male projection 110 takes on the physical appearance of a hypodermic needle. One suitable glue is ELMER'S TM glue, either diluted or nondiluted.

This forces the glue not only along the interface 18, but into all contiguous flooring joints, up and down loose nail holes, into seams and around exposed portions of nails and other floor fasteners as well as into contiguous spaces between the fibers of the wood comprising the top of the subfloor 14 and the lower portion of the floor 16.

Thereafter, the male projection 110 is vertically pulled from the access passageway comprising bores 26 and 28. Any residual glue is wiped away from the floor covering 24 and the injected glue within the floor is allowed to dry, solidify, and cure. The result is an essentially monolithic structure at the injection area wherein no floor component is free to move relative to any other floor component in that region.

By placing the access passageways in a closely spaced pattern, a large area wherein a floor previously squeaky in its nature responsive to persons walking across the floor can be made to be monolithic as described above. The area can be progressively enlarged in which injections take place until, by trial and error, the entire floor area is de-squeaked in the manner explained above. Any floor covering plugs, (areas of the floor covering removed to create openings 26 and/or 27) or areas where flaps have been cut from the floor covering can be replaced and adhesively secured in their original positions. Chemicals are available by which any resulting seam in the vinyl or linoleum floor covering can be visually negated.

Figure 4:
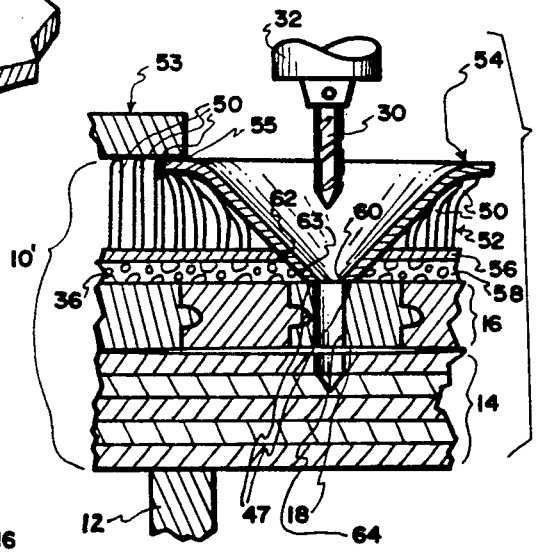
FIG. 4 is a fragmentary cross-section illustrating some steps and equipment used in accordance with the principles of the present invention, by which a carpet-covered floor may be de-squeaked without removal of the carpet, using a funnel-shaped drill guide having spike retainers.
Figure 4A:
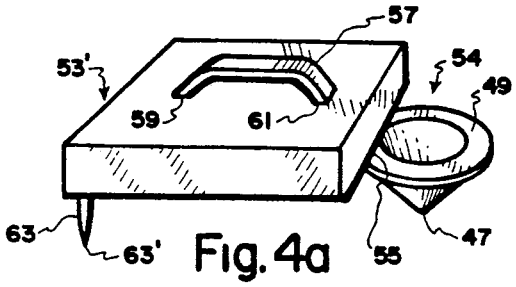
FIG. 4a is a perspective of the funnel-shaped drill guide of FIG. 4.

In the case of a carpet floor covering, as illustrated in FIG. 4, the funnel mechanism 54 maybe attached to a stabilizing block which is either without or with stabilizing spikes. A preferred non-spike block is illustrated in FIG. 2*a*, while a presently preferred spiked version is shown in FIG. 4*a*. With the funnel guide 54 positioned as illustrated in FIG. 4, the male projection 110 is extended through the funnel opening 60 and press-fit internally within the bore 64 prior to the above-described injection of glue or like flowable filler material.

Figure 7:
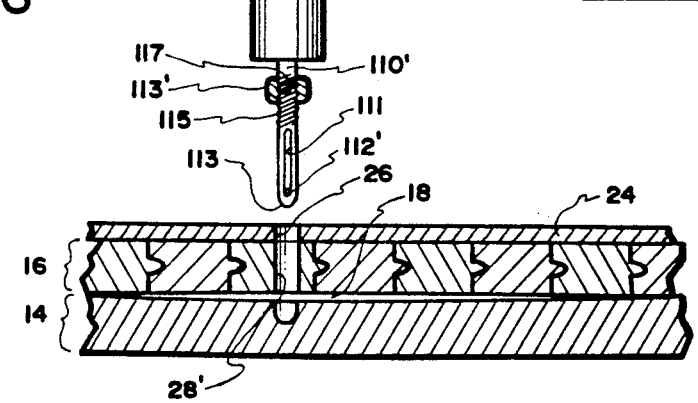
FIG. 7 is an elevational view, with parts broken away for clarity, of steps and equipment for practicing the present invention to impact penetrate a floor to the subfloor without drilling and to thereafter inject a filler glue to de-squeak a floor.

Reference is now made to FIG. 7, which illustrates an impact gun 90' similar in many respects to the gun 90. Corresponding numbers have been used where parts of gun 90' are identical to the above-described parts of gun 90. Only those parts which differ will be described. Fitting 96' connects the conduit 94 to the side rather than the end of the barrel 108'. The barrel 108' is larger and capable of absorbing impact forces without damage, diagrammatically illustrated by arrow 120 in FIG. 7. Impact forces, diagrammatically illustrated at 120, may be from any suitable source, such as those created by conventional impact tools, with the intent that the male projection 110' is driven through the floor 16 by the impact 120 along a corridor illustrated at 28' to dispose a hollow channel 111 side effluent port 112' at interface 18. The impact delivery of the male projection 110' drives rounded solid distal tip 113 of the male projection 110' through layer 16 of the floor into the subfloor 14 to create bore 28' and expose the channel 111 at interface 18. An adjustable annular seal 113' creates a force-fit sealed relationship between the exterior of the male projection 110' and the bore 28'. In this position, the above-described glue injection phase is initiated and completed. Male projection 110' comprises central threads 115. The adjustable annular seal 113' is correspondingly threaded at its interior bore at 117. By adjusting the location of the annular seal 113' in its threaded engagement upon threads 115 of male projection 110', the depth to which the distal tip 113 is permitted to penetrate is controlled and the location of the seal formed between the annular seal 113 and the bore 28' is determined.

With reference to FIG. 9, the glue injection phase may be practiced using the apparatus generally designated 130. Specifically, a conventional bracket 132, at collar 134, surrounds support shaft 86 at a location above the housing 84. Rotation of the surrounding collar 134 in respect to shaft 86 is conventionally prevented by a set screw 136, when tightened into position by a manual handle 138. The bracket 132 comprises a drill press mechanism, which comprises a conventional rack shaft 140, reciprocally carried within the housing 132 and a drill press manual handle 142, selective rotation of which in a well known manner reciprocates the rack shaft 140. A channel-shaped bracket 144 is releasibly clamped at 145 in a conventional manner to the exterior surface of a canister 146. The bracket 144 is connected by a pair of arms 148 and 150 to the reciprocable rack shaft 140. Thus, conventional selective rotation of the drill press handle 142 will vertically displace the rack shaft 140, the bracket 144, and the cylindrical canister 146. When lowered, in vertical alignment with a site where an access passageway of the type described above has been created, the male projection 110'' will be press-fit into the access passageway to create a seal therewith, following which glue contained within the canister 146 under high gas pressure is selectively delivered via effluent distal port 112'' to the desired floor interface.

The canister 146 is preferably loaded, using conventional methods, with a predetermined amount of flowable glue or like flowable filler material and a quantity of gas, such as nitrogen, under high pressure, for example, 700 psi. The canister 146 is typically formed of steel and comprises a hollow outlet at 152 by which flowable glue or the like under pressure is delivered through hollow fittings 154, and 156, to a valve 158. Valve 158 is conventional and comprises a manual handle 160, selective rotation of which opens and closes the interior of the valve 158 allowing and stopping, respectively, the flow of glue through hollow fittings 162 and 164 to the hollow interior of the male projection 110'' and out the egress opening 112'' at the distal end of the male projection 110 double prime.

In respect to FIG. 9, it should be observed that, as illustrated, four threaded shafts 170 support the shaft 86 and everything carried by the shaft 86. Each threaded shaft 170 is anchored in a blind threaded bore 172 in a base plate 174. By use of nuts 176, the support 178 for the shaft 86 is leveled, which causes the shaft 86 to extend in exactly a vertical direction. The support 178 rotationally receives a spindle mechanism 180 non-rotatably secured to the lower end of the shaft 86 by said screw 182.

A collar 184 comprising a threaded throughbore is anchored, for example by welding, to the support 178 and threaded receives a shaft 186, which at one end comprises an abutment 188 and at the other a handle 190 by which the shaft 186 is rotated. By advancing the threaded shaft 186, the abutment 188 is caused to forcibly engage an adjacent collar 192 of the spindle 180, thereby preventing rotation of the spindle, the shaft 86, the drill 32', and the injection canister 146.

By loosening the threaded shaft 186 so that the abutment 188 is removed from the collar 192, allowing rotation of the spindle 180, the shaft 86, the drill 32' and the glue injector canister 146. As mentioned above, preferably the drill bit 30 and the male projection 110'' travel along a common radius so that each in succession ca be rotated into a desired position for drilling and injection, respectively, merely by rotating.

Reference is made to FIG. 2*a*. The funnel device 54, previously described in conjunction with the FIG. 2, may be attached along a top radial flange 49, at weldment 55, to a heavy metal stabilizing block 53 which is without spikes. It is presently preferred that the stabilizing block 53 be rectangle in configuration and that it weighs approximately 15 pounds. Accordingly, when the tip of the funnel 54 is positioned as illustrated in FIG. 4, the funnel 54 will be stable and resist significantly any inadvertent displacement which might otherwise tear or damage the floor covering 24 at incision 34. The anchor block 53 preferably comprises a manual handle 57 of suitable metal secured at weldment sites 59 and 61 to the top of the block 53. The bottom surface of the anchor block 53 is illustrated as being flat and uninterrupted.

When the funnel mechanism 54 is to be used in conjunction with a spiked stabilizing block, it is presently preferred that the funnel mechanism 54 be secured to anchor block 53' (FIG. 4*a*), at weldment site 55. Weldment 55 is imposed between flange 49 of the funnel mechanism 54 and the underside of the stabilizing block 53'. Block 53' is identical to abutment block 53 except the undersurface of the block 53' is equipped with at least two pointed thin gripping fingers or spikes 63 (located adjacent each of the two corners of the block 53' remote from weldment 55). Each spike 63 is preferably comprised of a sharp tip 63' and comprises a vertical length extending below the bottom surface of the block 53' a distance substantially equal to the vertical distance spanned by of the funnel mechanism 53. Thus, when the block 53' and funnel mechanism 54 are integral and used concurrently, the funnel being placed into the position illustrated in FIG. 4, the tip 63' of each spike 63 will engage and be slightly depressed into the top surface of the floor 16 to retain the position of the block 53' and the funnel 54 and prevent inverted displacement.

Figure 10:
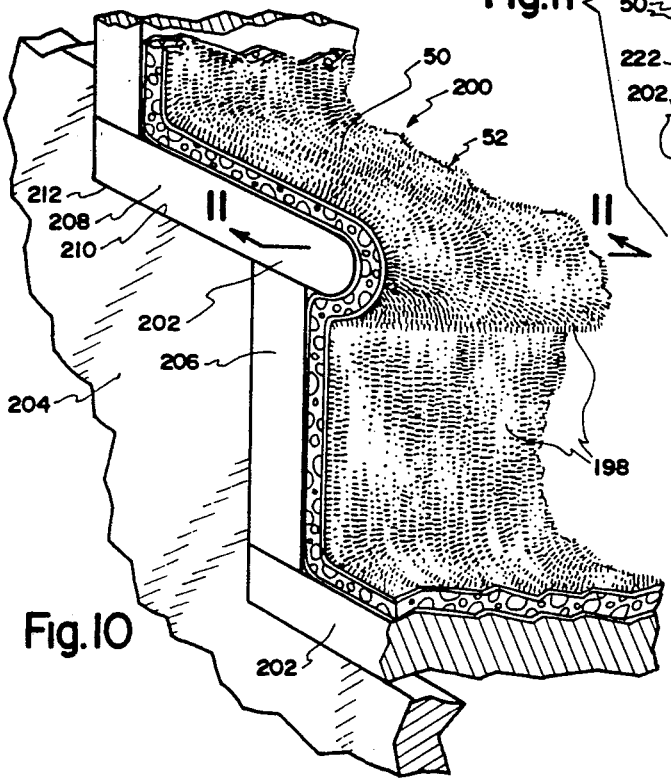
FIG. 10 is a fragmentary perspective of a covered stair showing a single riser and two stair steps.

For purposes of this specification, a stair may be considered to be an extension of a floor and the coverings thereof may be the same. Therefore, the methods and procedures described herein for gaining access through floor coverings to gaps and interfaces applies to stairs as well as to floors. As seen in FIG. 10, a stair step 198 of a flight of stairs 200 is illustrated as comprising a step or rest 202, a lateral support 204 disposed on each longitudinal end of each step 202, and a riser 206.

Although not necessarily so, a lateral support 204 is usually transversely disposed juxtaposed each longitudinal edge surface 208 of each step 202 such that a top supporting surface 210 of support 204 is juxtaposed a transverse supported edge surface 212 of step 202. While the interface between edge surfaces 210 and 212 comprises a potential source of squeaking, a common squeak producing joint in a stair step 198 is found in the joint between riser 206 and step 202.

Figure 11:
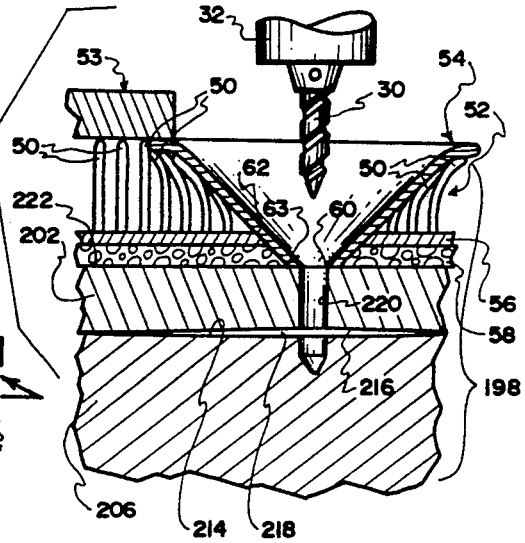
FIG. 11 is an enlarged cross-section taken along lines 11—11 of FIG. 10.

Reference is made to FIG. 11, wherein a joint between riser 206 and step 202 is seen to comprise a top edge surface 214 of riser 206 and an inferior longitudinal edge surface 216 of step 202. Where the interface between edge surfaces 214 and 216 is not closed, stair step 198 comprises a gap 218. As a user of the stairs places weight on step 202, the relative movement between edge surfaces 214 and 216 often is the source of a squeak, much the same as cavity 18 described earlier.

As earlier stated, flight of stairs 200 is illustrated as comprising a floor covering such as linoleum, tile, vinyl, or the like in similar manner to a floor. As seen in FIGS. 10 and 11, the depth of step 202 is usually readily determined by mere measurement.

To gain access to gap 218, a hole 220 is drilled, cut, reamed, cored, or removed in any suitable conventional way. As seen in FIG. 11, the creation of hole 220 may entail creation of an aperture in a covering such as carpet 52 in alignment with the hole 220. For access to a stair step under a covering, it is preferred that the diameter of hole 220 and the aperture in the backing 56 of the carpet 52 as well as the carpet pad 58 be small. Diameters on the order of 50/1000 of one inch may be used for stairs as well as floors. Larger access openings may be used, if desired. However, the larger the access opening, the greater the risk that damage to the stair covering may be caused to the extent that it will visually impair the appearance of the stair covering after the de-squeaking procedures have been completed.

To make hole 220, the small bore bit 30 used in conjunction with a conventional drill 32 may be used as earlier described. The drill may be either hand held or mounted in some type of a suitable drill press to insure correct alignment and reciprocation. Unless desired, each stair step 198 need not be treated to be de-squeaked, rather a test may be made of each stair step 198 and only those exhibiting undesirable squeaking so treated.

Hole 220 is vertically drilled through step 202 to a depth which crosses gap 218 and, as illustrated, partially invades riser 206. So made, hole 220 provides access to gap 218. If stair 200 is covered by linoleum or like floor covering, access to a site for making hole 220 is preferably made as earlier described for floor 16.

For purposes of explaining one way the present invention may be used to eliminate a stair squeak below a carpeted area of the stair step 198 at gap 218, reference is again made to FIG. 11. The pile 50 of carpet 52 is parted manually and metal funnel device 54 is placed into the parted area, spout down, to hold the pile away from the area where the access passageway 218 is to be formed. The carpet is seen to comprise the same backing 56 and carpet pad 58 previously described. As before, the lower annular tip of the funnel device is forced manually between threads of the carpet backing 56 and through the foam pad 58 until the tip thereof is essentially contiguous within a top surface 222 of step 202 and opening 60 is aligned with the desired bore site. Hole 220 is drilled as explained above, the depth of drilling being preferably slightly below gap 218.

Upon removal of drill bit 30, the hole 220 provides a passageway for access along which flowable filler material such as glue, is injected into the gap 218, as earlier explained. The filler material is allowed to cure and a squeak impeding interface is created between interfacing edges 214 and 216. Any squeak between edges 210 and 212 is eliminated in the same manner as that described for the joint between riser 206 and step 202.

It is to be appreciated that the apparatus seen in FIG. 9 may be used to position male projection 1 10" relative to drill 30 as earlier described.

Figure 12:
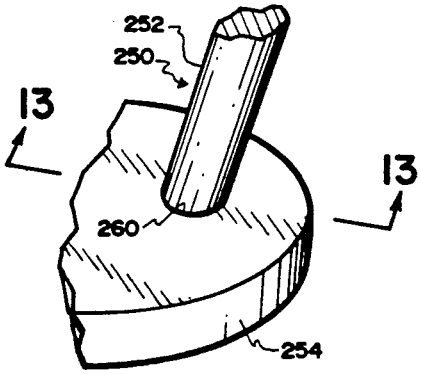
FIG. 12 is a fragmentary perspective of a furniture joint showing a male-female joint between two furniture components.
Figure 13:
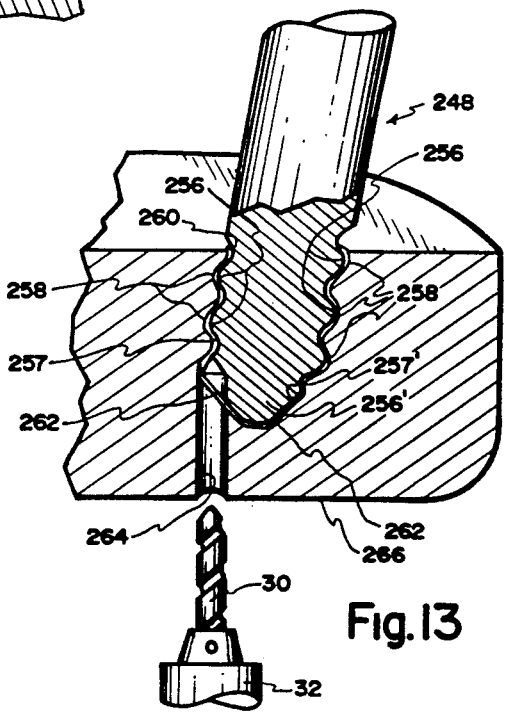
FIG. 13 is an enlarged cross-section taken along lines 13—13 of FIG. 12.

Reference is now made to FIGS. 12 and 13 which are concerned with removing squeaks from a piece of furniture, a fragmentary furniture joint 250 of which is seen therein. As seen in FIG. 12, furniture joint 250 comprising a male end 256' of a vertically extending member 252 is shown inserted into a blind bore of a substantially horizontal member 254.

Male end 250' is illustrated as comprising threads or helically disposed ribs 256 on the exterior surface 257. Complimentary helical grooves 258 on inner surface 257' of an accepting blind bore or recess 260 threaded interface to the helical threads 256 in mating relation. Initially or with time or due to a build-up of off-sizing manufacturing tolerances, a gap 262 may exist between the exterior surface 257 and inner surface 257'. As surface 257 is moved relative to inner surface 257', as, for example, during the use of the furniture, a squeak may result.

An access passageway for introduction of glue or like material is made to gap 262 using the techniques described herein. Thus, a blind hold 264 is drilled through to the gap 262. More specifically, as seen in FIG. 13, drill 32 activates drill 30 to drill blind bore 264 preferably through a previously concealed surface 266 of the furniture section 248. In the manner earlier described, passageway 264 is used to deliver glue or like material under pressure to gap or cavity 262. The glue or like material is allowed to cure to seal the filled joint and obstruct squeaking. The bore 264 may be plugged using conventional techniques, if desired.

It has been discovered that a power pressure paint sprayer can be used effectively to deliver glue or other like material to a squeak site as explained herein. This method of glue or like material delivery is less expensive.

A hollow male projection or delivery needle, such as a male projection similar in shape and function to male projection 110'', formed from a medical biopsy or puncture needle and comprising a threaded female hub or fitting may be used as a discharge structure for effluent glue from the paint sprayer. The female threaded hub or fitting is threadably connected to the existing threaded male part of the nozzle outlet of the paint sprayer. The biopsy or puncture needle is preferably truncated or shortened in length to provide a suitable discharge tube through which extruded glue or like material is delivered into a furniture joint through blind hold 264, for example.

A suitable liquid glue is ELMER'S TM glue having a viscosity the consistency of paint as normally used and delivered by the sprayer. A power painter such as the POWER PAINTER 235 KIT, available from Wagner Spray Tech Corporation, Minnesota, or the AIRLESS PAINT SPRAYER, Model PT2500, available from Grayco, Toledo, Ohio, may be used as a pressured delivery system for glue to joints as described herein.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of de-squeaking a construction joint comprising a squeak-causing void caused by imprecise construction between at least two partially juxtaposed structurally sound members comprising a first structurally sound member having an accessible surface, comprising the steps of:

creating a new pathway through the accessible surface of and internally along the first structurally sound member to expose the squeak-causing void;

displacing a flowable curable filler material under pressure along the pathway to fill the squeak-causing void;

permitting the filler material so disposed in the void to cure.

2. The method of de-squeaking a construction joint according to claim 1 wherein the creating step comprises creating a pathway through an accessible surface of and internally along a furniture member.

3. The method of de-squeaking a construction joint according to claim 1 wherein the creating step comprises creating a pathway through an accessible surface of and internally along a stair step member.

4. A method of de-squeaking stairs, comprising the steps of:

injecting, under pressure, a flowable filler material from a source into a squeak producing void caused by imprecise construction between at least two structurally sound members comprising the stairs along a predetermined path without disassembly of the stairs;

accommodating solidification of the filler material so disposed in said void to eliminate the squeak.

5. A method of de-squeaking a furniture joint comprising the steps of:

injecting, under pressure, a flowable filler material from a source into a squeak producing void at the joint between structurally sound furniture members along a predetermined path without furniture disassembly;

accommodating solidification of the filler material so disposed in said void.

6. A method of removing a squeak from a construction joint comprising at least two interrelated structurally sound members comprising the steps of:

creating a bore through a surface and along at least one of the structurally sound members to a construction-caused squeak producing void between the structurally sound members;

injecting a flowable filler material under pressure along the bore and thence into said squeak producing void without addition of reinforcement.

7. A method of de-squeaking a joint comprising a squeak producing void disposed between at least two structurally sound members, comprising the steps of:

creating a relatively small obscure access opening in an accessible surface of and along at least one member of the joint to the squeak producing void;

leaving the access opening unreinforced;

causing a removable hollow male projection of an injector to be positioned in the access opening so as to seal against the access opening;

thereafter injecting a flowable filler substance under pressure from the hollow male projection along the access opening between the seal site into the squeak producing void, at least partially filling the void;

removing the hollow male projection from the access opening; and allowing the injected filler substance at the interface to cure without addition of reinforcement.

8. A system for de-squeaking construction joint, said system comprising:

means for creating a passageway through an accessible surface of the construction joint to an interface comprising a void at least two squeak producing surfaces and a gap or cavity therebetween;

a liquid pressurizing, liquid delivery mechanism for injecting a flowable curable filler liquid into the interface along a flow path comprising the passageway and the gap or cavity.

9. A method of repairing a naturally occurring loose construction joint, comprising a squeak producing void between at least two partially juxtaposed structurally sound members comprising a first member having an accessible surface, comprising the steps of:

creating a pathway for injected fluid through the accessible surface of the first structurally sound member and therethrough along the pathway to the squeak producing void at the loose construction joint;

injecting, under pressure, a flowable filler material from a source along the pathway to at least partially fill the squeak producing void;

allowing the injected filler material at least partially filling the void to cure without adding reinforcement at either the pathway or the void.

10. The method according to claim 9 wherein the injecting step comprises delivering filler material to a void between structurally sound members comprising a stair bannister.

11. The method according to claim 9 wherein the allowing step comprises allowing the unreinforced injected filler material at least partially filling the void to cure and thereby form a monolithic structure which strengthens the joint.

12. The method according to claim 9 wherein the injecting step comprises injecting liquid glue under pressure provided by a conventional liquid pressurizing, liquid spraying apparatus.

13. A method of de-squeaking a floor comprising a structurally sound top floor segment, a structurally sound subfloor segment and a squeak producing void at a floor interface between the segments, comprising the steps of:

creating a new pathway through the structurally sound top floor segment to expose the void at the floor interface;

introducing a flowable curable filler material under pressure into the void at the interface via the pathway;

allowing the filler material in the void at the interface to cure.

14. A method of de-squeaking a finished composite floor comprising structurally sound floor components without disassembly of the floor components, comprising the steps of:

creating an opening thorugh a floor covering and creating a pathway through the floor, aligned with the opening through the floor covering, to an interior void location at a top surface of a subfloor;

preventing backflow while injecting a flowable filler glue under pressure along the pathway into the void location;

allowing the injected glue to cure at the void location;

closing the opening in the floor covering.

15. A method of de-squeaking an undamaged floor comprising the steps of:

injecting a flowable filler material from a source to a void between undamaged floor layers under pressure along a predetermined path without disassembly of undamaged floor components;

accommodating solidification of the filler material at said void without reinforcement being added.

16. A method of removing a squeak from an undamaged floor comprising the steps of:

creating a blind bore in the undamaged floor to access to a squeak producing void disposed at a top of an undamaged subfloor comprising the undamaged floor;

injecting a flowable filler material under pressure along a path comprising the blind bore and thence along the floor itself into the void.

17. A method of de-squeaking an undamaged floor comprising the steps of:

creating a small access opening from a surface of the undamaged floor at a squeak producing void location adjacent to an interface above an undamaged subfloor segment of the undamaged floor;

causing a removable hollow male projection to be positioned in the access opening so as to seal the access opening at a site thereof against flow between the seal site and said surface of the floor;

thereafter injecting a flowable filler substance under pressure through the male projection along the access opening between the seal site and the void;

removing the male projection from the access opening;

allowing the injected filler substance to cure.

18. A method according to claim 17 wherein the creating step comprises drilling the small access opening from a position above the floor.

19. A method of de-squeaking an undamaged floor comprising the steps of:

injecting a flowable filler material from a source under pressure to a squeak producing void adjacent to an interface disposed between an undamaged floor layer and an undamaged floor joist along a predetermined path without disassembly of undamaged floor components;

accommodating solidification of the filler material at said interface without adding any reinforcement.

20. A method of removing a squeak from a structurally sound floor comprising the steps of:

creating a blind bore in the structurally sound floor to access to a squeak producing void adjacent to an interface disposed at a top surface of a structurally sound floor joist;

injecting a flowable filler material under pressure along a path comprising the blind bore into the void.

* * * * *